US010428624B2

(12) United States Patent
Vasques

(10) Patent No.: US 10,428,624 B2
(45) Date of Patent: Oct. 1, 2019

(54) DOWNHOLE COMPLETION SYSTEM

(71) Applicant: Welltec Oilfield Solutions AG, Zug (CH)

(72) Inventor: Ricardo Reves Vasques, Allerød (DK)

(73) Assignee: Welltec Oilfield Solutions AG, Zug (CH)

( * ) Notice: Subject to any disclaimer, the term of this patent is extended or adjusted under 35 U.S.C. 154(b) by 88 days.

(21) Appl. No.: 15/720,261

(22) Filed: Sep. 29, 2017

(65) Prior Publication Data

US 2018/0094506 A1 Apr. 5, 2018

(30) Foreign Application Priority Data

Sep. 30, 2016 (EP) ..... 16191998
Oct. 12, 2016 (EP) ..... 16193459

(51) Int. Cl.
*E21B 17/00* (2006.01)
*E21B 17/02* (2006.01)
(Continued)

(52) U.S. Cl.
CPC ..... *E21B 41/0042* (2013.01); *E21B 17/003* (2013.01); *E21B 17/028* (2013.01);
(Continued)

(58) Field of Classification Search
CPC ..... E21B 17/003; E21B 17/026; E21B 43/14; E21B 43/26; E21B 47/12; E21B 47/122
(Continued)

(56) References Cited

U.S. PATENT DOCUMENTS

2001/0035288 A1 11/2001 Brockman et al.
2010/0101786 A1 4/2010 Lovell et al.
(Continued)

FOREIGN PATENT DOCUMENTS

WO WO 01/98632 A1 12/2001
WO WO 2009/040510 4/2009
WO WO 2012/018322 2/2012

OTHER PUBLICATIONS

International Search Report and Written Opinion of the International Search Authority dated Nov. 7, 2017 in International Application No. PCT/EP2017/074762 (14 pages).
(Continued)

*Primary Examiner* — David J Bagnell
*Assistant Examiner* — Dany E Akakpo
(74) *Attorney, Agent, or Firm* — Nixon & Vanderhye P.C.

(57) ABSTRACT

A downhole completion system includes an intermediate casing, an outer production casing arranged at least partly within the intermediate casing, a main barrier to seal between the intermediate casing and the outer production casing, and an inner production casing arranged at least partly within the outer production casing. The outer production casing has a first outer inductive coupling arranged below the main barrier, and a first inner inductive coupling is arranged on an outer face of the inner production casing for wireless transfer of communication signals and/or power therebetween. The first inner inductive coupling is connected to the top of the borehole via a first electrical conductor, and a second outer inductive coupling is arranged on an outer face of the outer production casing and connected with the first outer inductive coupling via a second electrical conductor.

19 Claims, 6 Drawing Sheets

Figure 1:
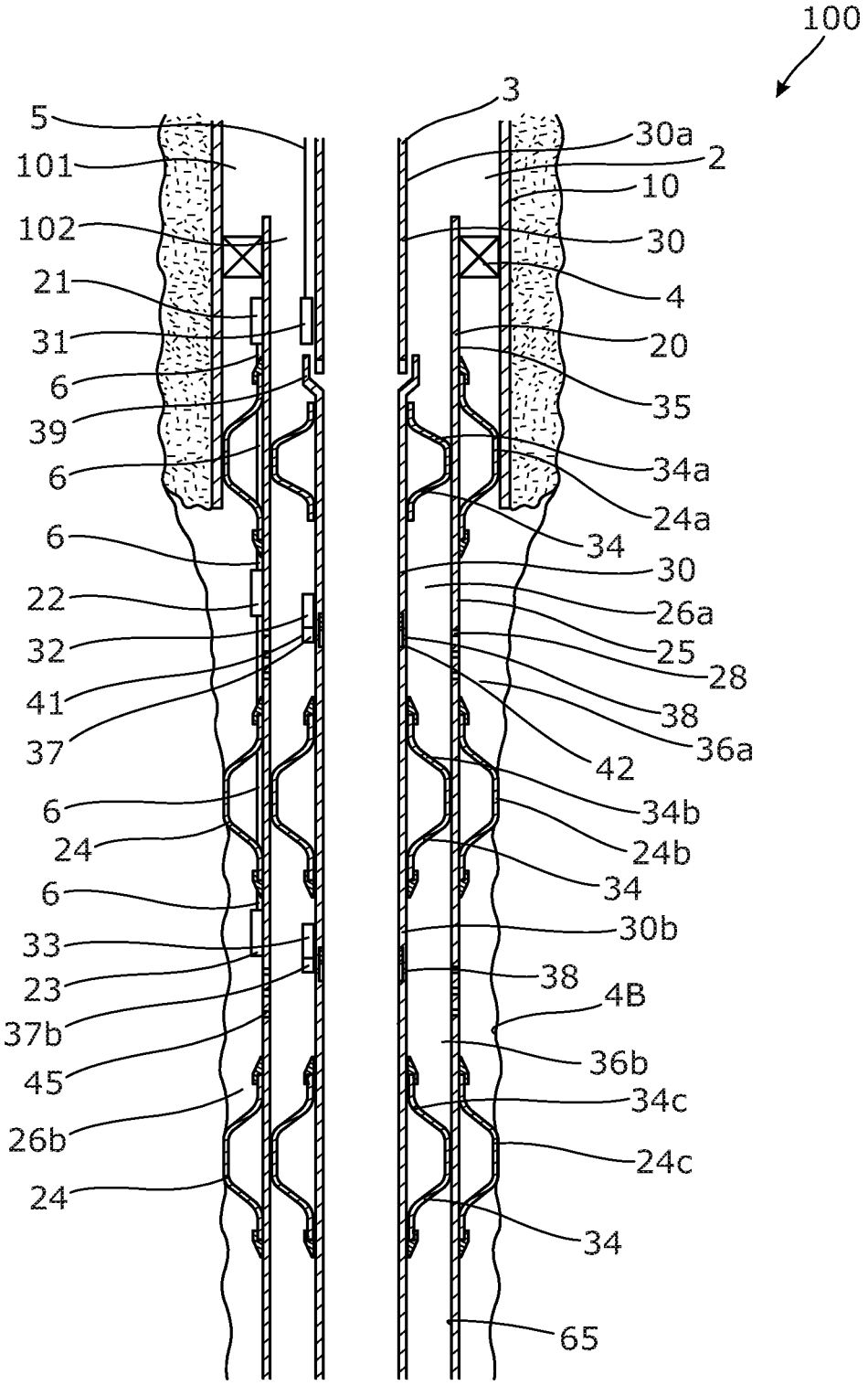

(51) Int. Cl.
*E21B 41/00* (2006.01)
*E21B 47/12* (2012.01)

(52) U.S. Cl.
CPC ..... *E21B 41/0085* (2013.01); *E21B 47/12* (2013.01); *E21B 47/122* (2013.01)

(58) Field of Classification Search
USPC ..... 367/82
See application file for complete search history.

(56) References Cited

U.S. PATENT DOCUMENTS

| | | | | |
|---|---|---|---|---|
| 2013/0087325 | A1 | 4/2013 | Bartko et al. | |
| 2014/0266210 | A1 | 9/2014 | Godager | |
| 2016/0341030 | A1* | 11/2016 | Mulholland | E21B 47/0001 |
| 2017/0074048 | A1* | 3/2017 | Patel | E21B 23/01 |

OTHER PUBLICATIONS

Extended EP Search Report for EP16193459.1, dated Feb. 17, 2017, 8 pages.

* cited by examiner

DOWNHOLE COMPLETION SYSTEM

This application claims priority to EP Patent Application No. 16191998.0 filed 30 Sep. 2016, and EP Patent Application No. 16193459.1 filed 12 Oct. 2016, the entire contents of each of which are hereby incorporated by reference.

The present invention relates to a downhole completion system and to a downhole communication or transferring method in a downhole completion system according to the present invention.

Many cased wells are double-cased, which induces the challenges of operating components down the well by means of control lines etc. Examples of prior art systems are described in e.g. US 2014/266210. When inserting casings having control lines on the outside, the control lines may be damaged or become inoperative over the years. When having an inner production casing with electrical lines along the outer face as in US 2014/266210, these electrical lines may become damaged when run in and when the barriers have been set, the inner production casing can be very difficult to pull out if tests show that the electrical lines have become damaged. Even if the electrical lines are successfully pulled out of the well, the annular barriers need to be replaced with new electrical lines before running the inner production casing in again.

Furthermore, such control lines may be displaced and thus interfere with the function of the component which is to be operated. Therefore, in recent years the wells have been developed to be simpler since the double-cased wells and the highly instrumented completions have shown not to function properly over a long time span. Furthermore, when abandoning a well, the control lines have also shown to constitute a challenge, since when cement is poured down the well to seal it, leakages occur along the control lines, and therefore many attempts have been made to develop methods of cutting these lines before abandoning the well.

It is an object of the present invention to wholly or partly overcome the above disadvantages and drawbacks of the prior art. More specifically, it is an object to provide an improved downhole system which is easy to operate and easy to replace and abandon.

The above objects, together with numerous other objects, advantages and features, which will become evident from the below description, are accomplished by a solution in accordance with the present invention by a downhole completion system comprising:

- an intermediate casing arranged in a borehole having a top,
- an outer production casing arranged at least partly within the intermediate casing defining a primary annulus therebetween,
- a main barrier configured to provide a primary seal between the intermediate casing and the outer production casing, and
- an inner production casing arranged at least partly within the outer production casing defining a secondary annulus therebetween, wherein the outer production casing comprises a first outer inductive coupling arranged below the main barrier in relation to the top, a first inner inductive coupling is arranged on an outer face of the inner production casing positioned substantially in the same horizontal level as the first outer inductive coupling for wireless transfer of communication signals and/or power therebetween, the first inner inductive coupling being connected to the top via a first electrical conductor, a second outer inductive coupling is arranged on an outer face of the outer production casing below the first outer inductive coupling and connected with the first outer inductive coupling via a second electrical conductor, and a second inner inductive coupling is arranged on the outer face of the inner production casing positioned substantially in the same horizontal level as the second outer inductive coupling for wireless transfer of communication signals and/or power therebetween.

Due to the fact that the electrical conductors run on the outside of the outer production casing below the main barrier, the inner production casing may be easily replaced by pulling the inner production casing, or just the upper part of the inner production casing, out and inserting a new one or a new upper part. Furthermore, no electrical conductors interfere with any completion components, e.g. sliding sleeves, in the inner production casing. And furthermore, when retrieving the inner production casing, or just the upper part of the inner production casing, the well can easily be abandoned by plugging and cementing it, and hence no electrical conductors are cemented, and thus there is no risk that the well will leak along such electrical conductors.

The second inner inductive coupling may be wireless.

Moreover, the inner production casing may comprise a first inner annular barrier and a second inner annular barrier configured to provide zonal isolation of a first inner zone in the secondary annulus, the first inner annular barrier being arranged between the first inner inductive coupling and the second inner inductive coupling, and the second inner annular barrier being arranged below the second inner inductive coupling, so that the second inner inductive coupling is arranged in the first inner zone.

Also, the inner production casing may comprise a completion component arranged between the first inner annular barrier and the second inner annular barrier.

Further, the second inner inductive coupling may be connected with the completion component.

In addition, the completion component may be an actuator for moving a sleeve in order to cover or uncover at least one inner opening in the inner production casing.

Moreover, the outer production casing may comprise a first outer annular barrier and a second outer annular barrier to provide zonal isolation of a first outer zone in the primary annulus.

Also, the outer production casing may have at least one outer opening between the first outer annular barrier and the second outer annular barrier.

An acid-soluble plug may be arranged in the outer opening in the outer production casing.

Furthermore, the second electrical conductor may electrically connect the first outer inductive coupling and the second outer inductive coupling, the second electrical conductor extending through the first outer annular barrier.

Additionally, a third outer annular barrier may be arranged below the second outer annular barrier to provide a second outer zone, and a third outer inductive coupling may be arranged in the second outer zone and may be connected with the second outer inductive coupling by an electrical conductor.

Also, an intermediate outer inductive coupling may be arranged on the outer face of the outer production casing above the main barrier and positioned substantially in the same horizontal level as the first inner inductive coupling for wireless transfer of communication signals and/or power therebetween, and the intermediate outer inductive coupling may be connected with the first outer inductive coupling via the second electrical conductor.

Further, a production packer may be arranged between the inner production casing and the outer production casing.

Moreover, a third inner annular barrier may be arranged below the second inner annular barrier to provide a second inner zone opposite the second outer zone.

Also, a third inner inductive coupling may be arranged in the second inner zone, the third inner inductive coupling being wireless.

The third inner inductive coupling may be connected with a second completion component.

In addition, the third outer inductive coupling may wirelessly transfer communication signals and/or power to the third inner inductive coupling.

Further, the inner production casing may have an upper part separated from a lower part, the first inner inductive coupling may be arranged on the upper part, and the first inner annular barrier may be arranged on the lower part.

The completion component may be a sensor.

Additionally, the sensor may be a temperature sensor or a pressure sensor.

Moreover, the lower part may have a polished bore receptacle for receiving the upper part.

The upper part may have no annular barriers.

Furthermore, the first inner annular barrier may be the barrier closest to the top.

The annular barrier in the downhole completion system, as described above, may comprise:

a tubular metal part for mounting as part of the production casing, the tubular metal part having a first expansion opening and an outer face, an expandable metal sleeve surrounding the tubular metal part and having an inner face facing the tubular metal part and an outer face facing a wall of the borehole or an inner face of another production casing, each end of the expandable metal sleeve being connected with the tubular metal part, and an annular space between the inner face of the expandable metal sleeve and the tubular metal part, the expandable metal sleeve being configured to expand by entering pressurised fluid into the annular space through the first expansion opening.

Each end of the expandable metal sleeve may be connected with the tubular metal part by means of connection parts.

Further, the inner annular barrier may be a packer.

Also, the electrical conductor may extend through the connection part of the annular barrier.

Said connection part may have a connection element for connecting and sealing the electrical conductor to the connection part.

Moreover, the expansion opening may be fluidly connected with a valve system.

The valve system may have two positions, a first position allowing fluid communication from inside the tubular part to enter the space, and a second position in which the fluid communication between the space and the inside is shut off and fluid communication between the space and the annulus is opened.

The downhole completion system may further comprise a control unit arranged within the inner production casing for moving a completion component, such as a sleeve, to open, choke or close the opening, wherein the control unit may comprise:

a first part having at least one member engaging the completion component, such as a profile of a sleeve, and a second part having:

a fixation unit fixating the sleeve control in the casing, an actuator for moving the first part in relation to the second part, and a power supply, such as a battery, supplying power to the actuator.

The control unit may comprise a first communication module for receiving control signals from surface.

Furthermore, the outer production casing and/or the inner production casing may be mounted from tubular sections where at least one tubular section opposite one inductive coupling is made from a non-magnetic material, such as a non-magnetic metal.

The present invention also relates to a downhole communication or transferring method in a downhole completion system as described above, the downhole communication or transferring method comprising:

sending a signal and/or power from the top to the first inner inductive completion through the first electrical conductor, wirelessly transferring the signal and/or power from the first inner inductive coupling to the first outer inductive coupling, sending the signal and/or power from the first outer inductive coupling to the second outer inductive coupling through a second electrical conductor, and wirelessly transferring the signal and/or power from the second outer inductive coupling to the second inner inductive coupling.

The second inner inductive coupling may then transfer signals and/or power to the completion component which then performs an operation, such as sliding or rotating the sleeve or measuring the temperature, pressure and/or flow of fluid.

After having performed the operation, the completion component may then send a signal to the second inner inductive coupling which transfers the signal to the second outer inductive coupling and further through the electrical conductor to the first outer inductive coupling and further to the first inner inductive coupling through the electrical conductor to surface.

The present invention also relates to a downhole completion method for completion of a downhole completion system as described above, the downhole completion method comprising:

first drilling the borehole, inserting the intermediate casing, cementing the casing to the wall of the borehole, drilling a second part of the borehole, inserting the outer production casing into the intermediate casing, which outer production casing extends further into the borehole than the intermediate casing, expanding the main barrier between the intermediate casing and the outer production casing, expanding the outer annular barriers to provide outer zones, inserting the inner production casing into the outer production casing, and expanding the inner annular barriers to provide an inner zone between the outer production casing and the inner production casing.

In the event that the outer openings in the outer production casing comprise acid-soluble plugs, e.g. made of aluminium, the inner openings may be uncovered and acid may flow down the inner production casing and out into the inner zones to dissolve the acid-soluble plugs.

The present invention also relates to a downhole abandoning method for abandoning the downhole system as described above, the downhole abandoning method comprising:

retrieving at least part of the inner production casing, inserting a plug into the outer production casing, and filling part of the well with cement on top of the plug and on top of the main barrier.

Figure 2:
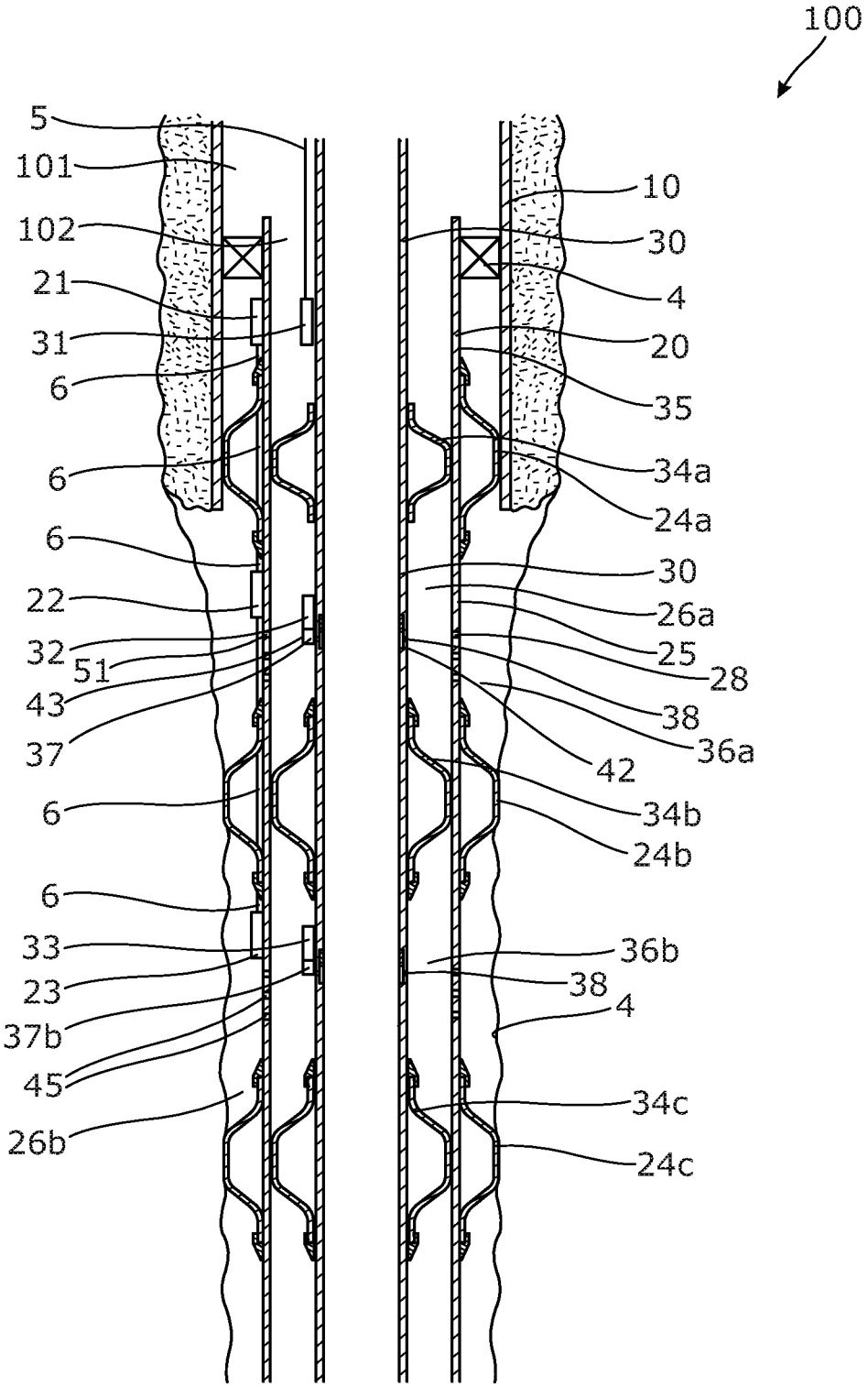
Figure 3:
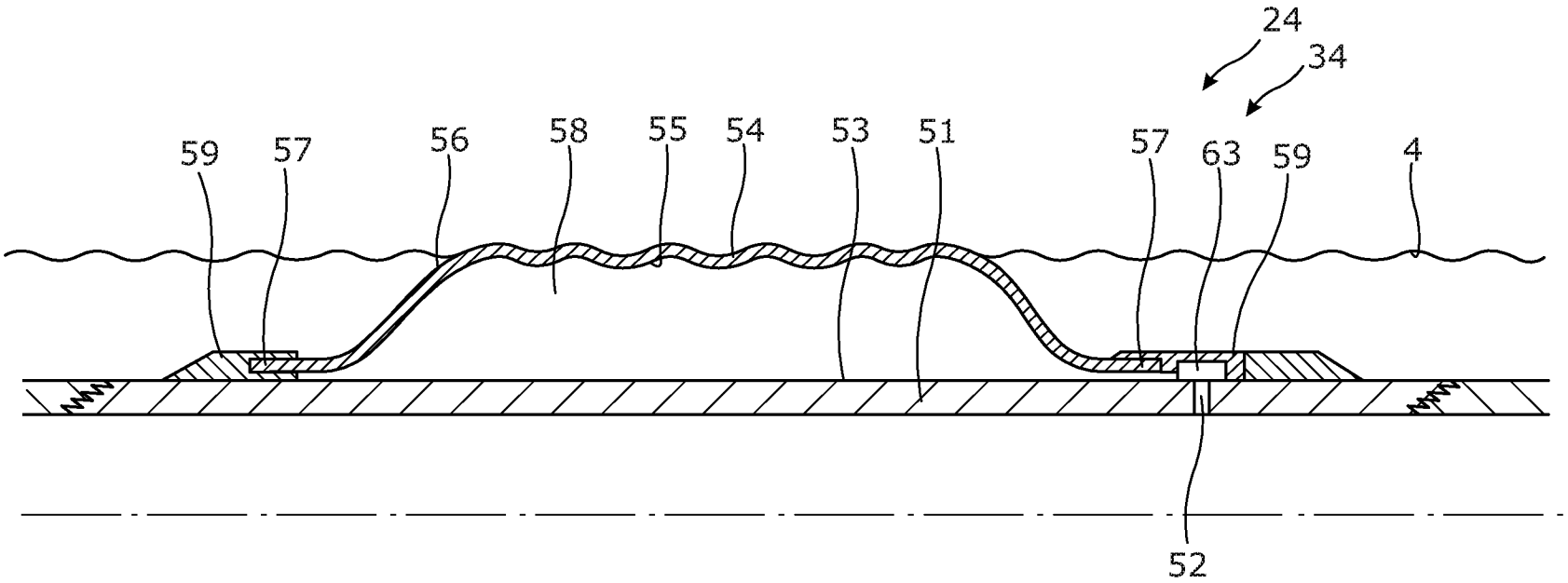
Figure 4:
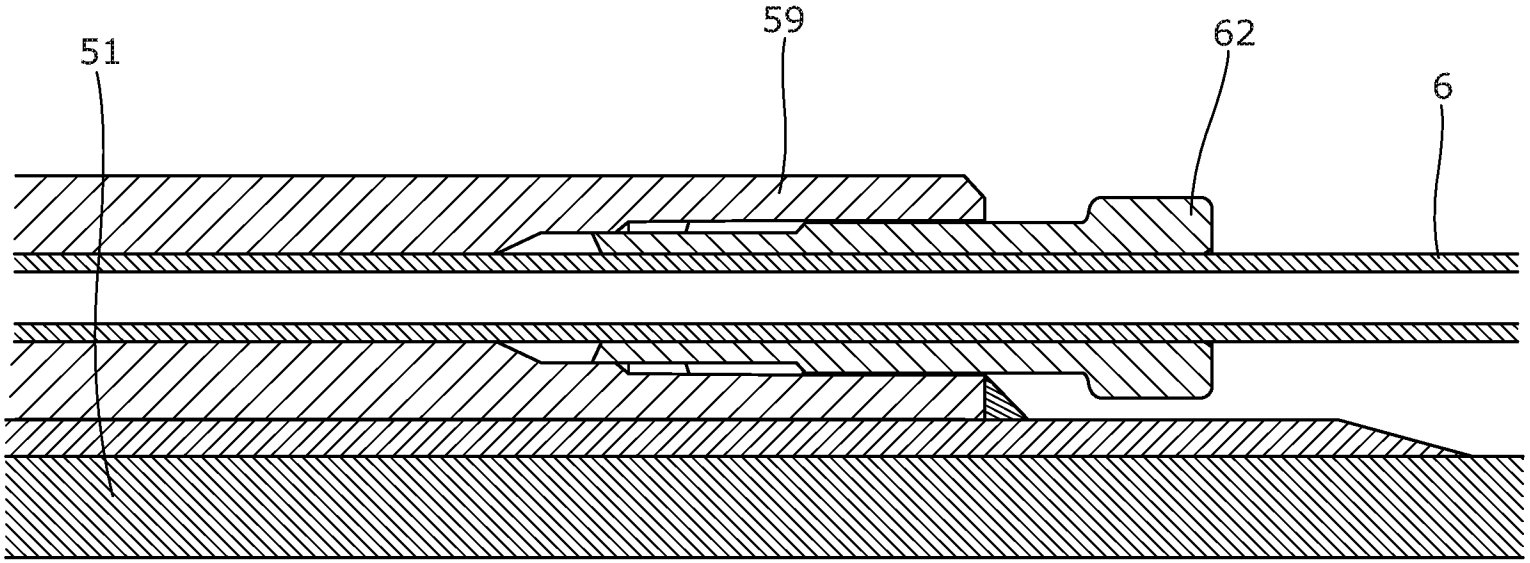
Figure 5:
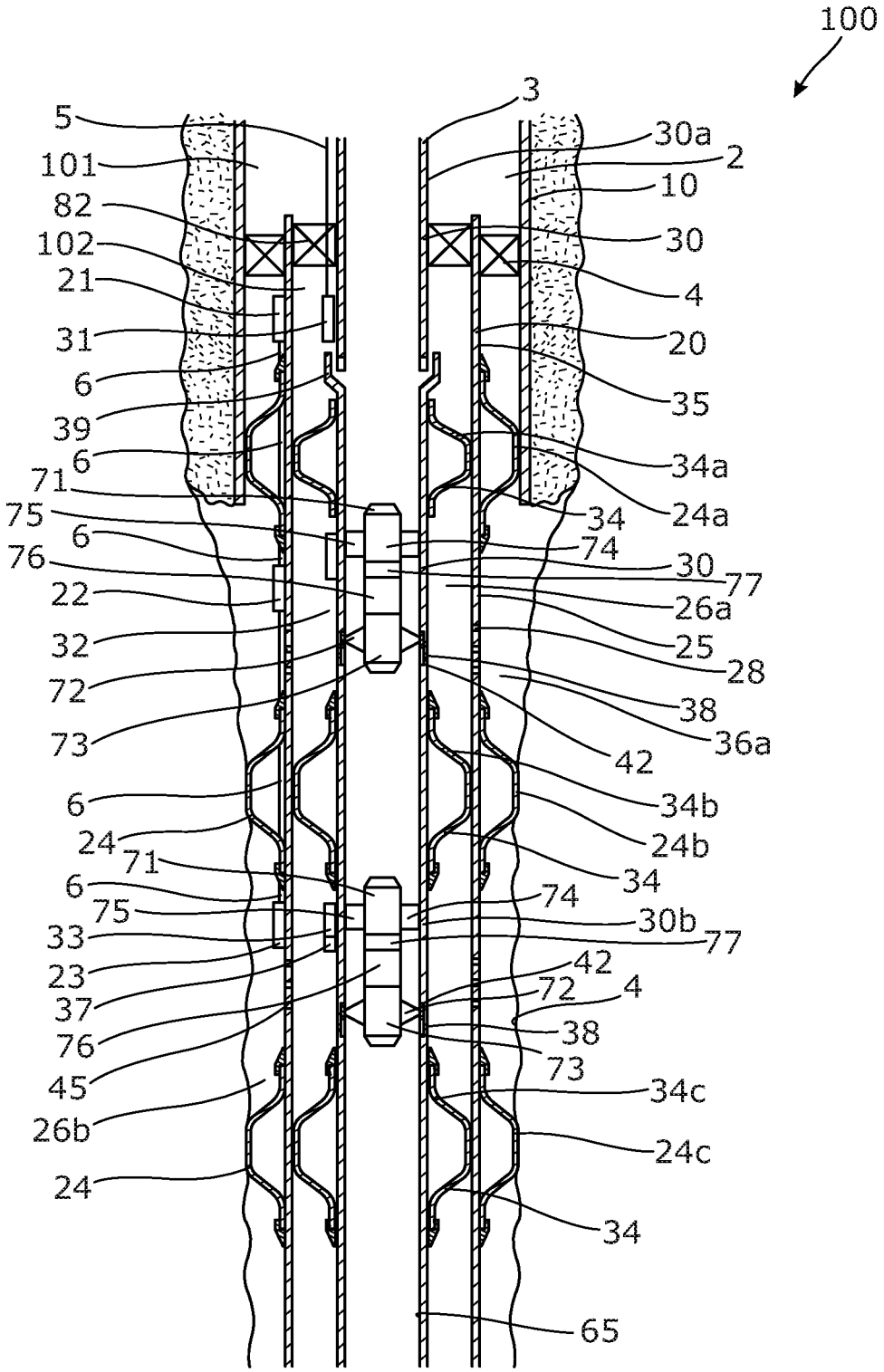
Figure 6:
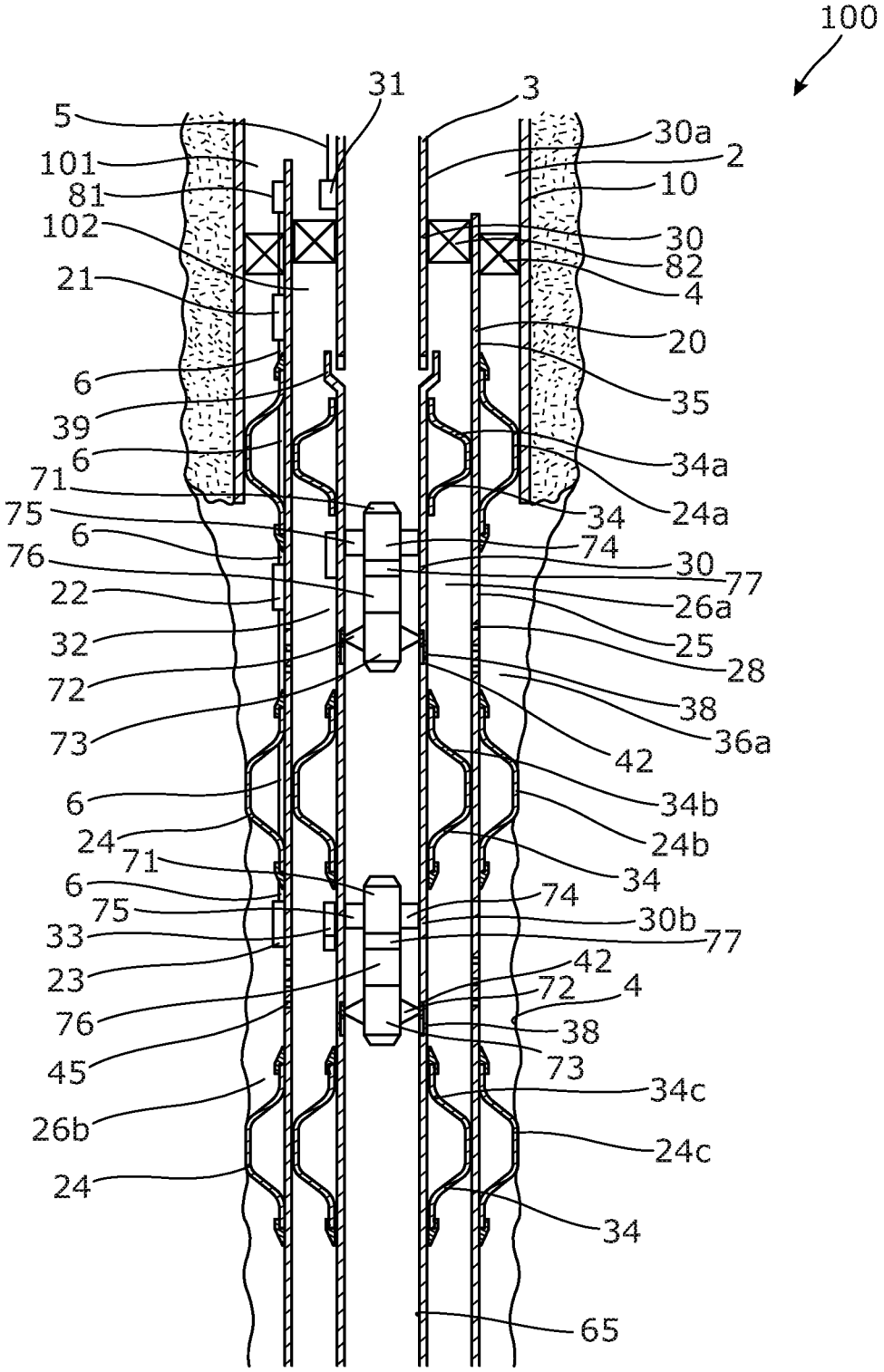

The invention and its many advantages will be described in more detail below with reference to the accompanying schematic drawings, which for the purpose of illustration show some non-limiting embodiments and in which:

FIG. 1 shows a downhole completion system which is a double-cased completion having an inner production casing and an outer production casing, FIG. 2 shows another downhole completion system, FIG. 3 shows a cross-sectional view of an annular barrier having a valve system, FIG. 4 shows a cross-sectional view of part of an annular barrier having an electrical conductor extending through the annular barrier, FIG. 5 shows a cross-sectional view of another downhole completion system, and FIG. 6 shows a cross-sectional view of another downhole completion system.

All the figures are highly schematic and not necessarily to scale, and they show only those parts which are necessary in order to elucidate the invention, other parts being omitted or merely suggested.

FIG. 1 shows a downhole completion system 100 comprising an intermediate casing 10 arranged in a borehole 2 having a top 3 and an outer production casing 20 arranged at least partly within the intermediate casing defining a primary annulus 101 therebetween. The downhole completion system 100 further comprises a main barrier 4 configured to provide a primary seal between the intermediate casing and the outer production casing, and the main barrier 4 is arranged in the primary annulus. The downhole completion system 100 further comprises an inner production casing 30 arranged at least partly within the outer production casing defining a secondary annulus 102 therebetween. The outer production casing comprises a first outer inductive coupling 21 arranged below the main barrier in relation to the top. A first inner inductive coupling 31 is arranged on an outer face 35 of the inner production casing positioned substantially in the same horizontal level as the first outer inductive coupling for wireless transfer of communication signals and/or power between the first inner inductive coupling 31 and the first outer inductive coupling 21. The first inner inductive coupling is connected to the top via a first electrical conductor 5. However, the electrical conductor does not extend past a main barrier 4, which is the case for some known well completion. A second outer inductive coupling 22 is arranged on an outer face 25 of the outer production casing below the first outer inductive coupling and is connected with the first outer inductive coupling via a second electrical conductor 6 extending along the outer face but not past the main barrier 4. A second inner inductive coupling 32 is arranged on the outer face of the inner production casing positioned substantially in the same horizontal level as the second outer inductive coupling for wireless transfer of communication signals and/or power between the second inner inductive coupling 32 and the second outer inductive coupling 22. The second inner inductive coupling is wireless and is thus not connected to an electrical conductor or to any one of the induction couplings.

The inner production casing further comprises a first inner annular barrier 34, 34*a* and a second inner annular barrier 34, 34*b* configured to provide zonal isolation of a first inner zone 36*a* in the secondary annulus. The first inner annular barrier is arranged between the first inner inductive coupling and the second inner inductive coupling, and the second inner annular barrier is arranged below the second inner inductive coupling, so that the second inner inductive coupling is arranged in the first inner zone.

The inner production casing comprises a completion component 37 arranged between the first inner annular barrier and the second inner annular barrier and the completion component 37 receives communication signals and/or power from the second inner inductive coupling. In FIG. 1, the completion component is an actuator 41 for moving a sleeve 42 in order to cover or uncover at least one inner opening 38 in the inner production casing. The outer production casing comprises a first outer annular barrier 24, 24*a* and a second outer annular barrier 24, 24*b* to provide zonal isolation of a first outer zone 26*a* in the primary annulus. The outer production casing has at least one outer opening 28 between the first outer annular barrier and the second outer annular barrier, so that once the sleeve uncovers the inner opening, fluid from the first outer zone 26*a* can flow in through the first outer opening 28 and into the first inner zone and further through the inner opening 38 and into the inner production casing. When deploying the outer production casing, the outer opening(s) may be plugged with an acid-soluble plug 45, so that once acid is supplied to the first inner zone, the plug is dissolved and flow through the outer opening 28 is allowed.

The second electrical conductor 6 electrically connects the first outer inductive coupling 21 and the second outer inductive coupling 22, and the second electrical conductor extends through the first outer annular barrier 24, 24*a* to be connected with a second outer inductive coupling 22.

The outer production casing further comprises a third outer annular barrier 24, 24*c* arranged below the second outer annular barrier to provide a second outer zone between the second outer annular barrier and the third outer annular barrier. A third outer inductive coupling 23 is arranged in the second outer zone 26*b* and is connected with the second outer inductive coupling by the electrical conductor 6. The inner production casing further comprises a third inner annular barrier 34, 34*c* arranged below the second inner annular barrier to provide a second inner zone 36*b* opposite the second outer zone. A third inner inductive coupling 33 is arranged in the second inner zone, and the third inner inductive coupling is wireless and thus not connected to an electrical conductor or any one of the induction couplings. The third inner inductive coupling is connected with a second completion component 37*b*, which is also an actuator for moving a sleeve to cover or uncover an outer opening 28. The third outer inductive coupling wirelessly transfers communication signals and/or power to the third inner inductive coupling which provides communication signals and/or power to the second completion component 37*b*.

The inner production casing 30 has an upper part 30*a* separated from a lower part 30*b*, and the first inner inductive coupling is arranged on the upper part and the first inner annular barrier is arranged on the lower part. The lower part has a polished bore receptacle 39 for receiving the upper part. By having the inner production casing divided in at least two parts, the upper part 30*a* can be designed without any annular barriers and it can easily be pulled for replacing the electrical conductor if the conductor shows to be deteriorated during the running in the inner production casing or later on. The lower part having annular barriers, i.e. the first inner annular barrier 34, 34*a* and the second inner annular barrier 34, 34*b*, does not have any electrical conductors and it is therefore not in the risk of having to be pulled due to conductor failure.

In FIG. 2, the inner production casing 30 is mounted in one string, but the electrical conductor does not extend past the inner annular barrier and past the completion component 37, and the risk of interference with the function of the completion component or the inner annular barrier is thus eliminated. Thus, the inner production casing 30 of both FIG. 1 and FIG. 2 is easily retrievable, and the electrical conduction is provided to the completion component without interfering with it.

In FIG. 2, the completion component comprises a sensor 43, and the sensor may be a temperature sensor and/or a pressure sensor and/or a flow meter.

As shown in FIG. 3, the annular barrier 24, 34 comprises a tubular metal part 51 for mounting as part of the production casing. The tubular metal part has a first expansion opening 52 and an outer face 53. The annular barrier further comprises an expandable metal sleeve 54 surrounding the tubular metal part and having an inner face 55 facing the tubular metal part and an outer face 56 facing a wall 4B of the borehole or an inner face 65 (as shown in FIG. 1) of another production casing. Each end 57 of the expandable metal sleeve is connected with the tubular metal part, defining an annular space 58 between the inner face of the expandable metal sleeve and the tubular metal part. The expandable metal sleeve is configured to expand by entering pressurised fluid into the annular space through the first expansion opening. Each end 57 of the expandable metal sleeve is connected with the tubular metal part by means of connection parts 59. The expansion opening 52 is fluidly connected with a valve system 63. The valve system has two positions, a first position allowing fluid communication from inside the tubular part to enter the space, and a second position in which the fluid communication between the space and the inside is shut off and fluid communication between the space and the annulus is opened.

The inner annular barrier may be a conventional packer and not an annular barrier shown in FIG. 3.

The electrical conductor 6 extends through a connection part 59 of the annular barrier as shown in FIG. 4, where a connection element 62 connects and seals the electrical conductor to the connection part.

The downhole system communicates and transfers communication signals and/or power by sending a signal and/or power from the top to the first inner inductive completion through the first electrical conductor, then wirelessly transferring the signal and/or power from the first inner inductive coupling to the first outer inductive coupling, and further sending the signal and/or power from the first outer inductive coupling to the second outer inductive coupling through a second electrical conductor, and then wirelessly transferring the signal and/or power from the second outer inductive coupling to the second inner inductive coupling.

The second inner inductive coupling then transfers signals and/or power to the completion component which then performs an operation, such as sliding or rotating the sleeve or measuring the temperature, pressure and/or flow of fluid.

After having performed the operation, the completion component may then send a signal to the second inner inductive coupling which transfers the signal to the second outer inductive coupling and further through the electrical conductor to the first outer inductive coupling and further to the first inner inductive coupling through the electrical conductor to surface.

The downhole system is completed by first drilling the borehole, then inserting the intermediate casing and cementing the intermediate casing to the wall of the borehole. Subsequently, a second part of the borehole is drilled and the outer production casing is inserted/run into the intermediate casing and the production casing extends further into the borehole than the intermediate casing. The main barrier is then expanded between the intermediate casing and the outer production casing, and subsequently the outer annular barriers are expanded to provide outer zones therebetween. Then the inner production casing is inserted into the outer production casing and the inner annular barriers are expanded to provide inner zones between the outer production casing and the inner production casing. In the event that the outer openings in the outer production casing comprise acid-soluble plugs, e.g. made of aluminium, the inner openings are uncovered and acid flows down the inner production casing and out into the inner zones to dissolve the acid-soluble plugs.

In the event that the well needs to be abandoned, the inner production casing is retrieved, and a plug is inserted into the outer production casing, and part of the well is then filled with cement on top of the plug and on top of the main barrier. Due to the fact that the inner production casing is retrieved and the electrical conductors run on the outside of the outer production casing below the main barrier, no electrical conductors are cemented, and thus there is no risk that the well will leak along such electrical conductors. The inner production casing may also be easily replaced by pulling the inner production casing, or just pulling the upper part of the inner production casing out and inserting a new one or a new upper part.

In FIG. 5, the downhole completion system further comprises a control unit 71 arranged within the inner production casing for moving a completion component 37, such as a sleeve 42, to open, choke or close the opening 38. The control unit comprises a first part 72 having at least one member 73 engaging the completion component, in that the member 73 engages a profile of the sleeve 42. The control unit 71 further comprises a second part 74 having a fixation unit 75 fixating the sleeve control in the inner production casing. Furthermore, the control unit comprises an actuator 76 for moving the first part in relation to the second part, and a power supply 77, such as a battery, supplying power to the actuator. The control unit receives communication signals and/or power through the fixation unit 75 of the second part 74 to move the sleeve to open, choke or close the opening 38.

The control unit may thus comprise a communication module for receiving the signals and sending signals to surface through the inner and outer inductive couplings and the conductors.

In FIG. 6, the downhole completion system 100 further comprises an intermediate outer inductive coupling 81 which is arranged on the outer face 25 of the outer production casing 20 above the main barrier 4 and positioned substantially in the same horizontal level as the first inner inductive coupling 31 for wireless transfer of communication signals and/or power therebetween. The intermediate outer inductive coupling 81 is connected with the first outer inductive coupling 21 via the second electrical conductor 6.

Data from e.g. a sensor measuring pressure may be sent comprising only the differences in pressure from the most recent measurement and not the actual measurement. Actual measurements may also be sent, and in a period between sending two actual measurements, data reflecting only the difference in e.g. pressure from the most recently measured pressure may be sent several times during the period. The period may be varied when required.

Furthermore, in FIG. 6, the downhole completion system 100 further comprises a production packer 82, which is arranged between the inner production casing 30 and the outer production casing 20.

The outer production casing and/or the inner production casing may be mounted from tubular sections where at least one tubular section opposite one of the inductive couplings is made from a non-magnetic material, such as a non-magnetic metal.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

Although the invention has been described in the above in connection with preferred embodiments of the invention, it will be evident for a person skilled in the art that several modifications are conceivable without departing from the invention as defined by the following claims.

The invention claimed is:

1. A downhole completion system comprising:

an intermediate casing arranged in a borehole having a top, an outer production casing arranged at least partly within the intermediate casing defining a primary annulus therebetween, a main barrier configured to provide a primary seal between the intermediate casing and the outer production casing, and an inner production casing arranged at least partly within the outer production casing defining a secondary annulus therebetween, wherein the outer production casing comprises a first outer inductive coupling arranged below the main barrier in relation to the top, a first inner inductive coupling is arranged on an outer face of the inner production casing positioned substantially in the same horizontal level as the first outer inductive coupling for wireless transfer of communication signals and/or power therebetween, the first inner inductive coupling being connected to the top via a first electrical conductor, a second outer inductive coupling is arranged on an outer face of the outer production casing below the first outer inductive coupling and connected with the first outer inductive coupling via a second electrical conductor, and a second inner inductive coupling is arranged on the outer face of the inner production casing positioned substantially in the same horizontal level as the second outer inductive coupling for wireless transfer of communication signals and/or power therebetween.

2. The downhole completion system according to claim 1, wherein the second inner inductive coupling is wireless.

3. The downhole completion system according to claim 1, wherein the inner production casing comprises a first inner annular barrier and a second inner annular barrier configured to provide zonal isolation of a first inner zone in the secondary annulus, the first inner annular barrier being arranged between the first inner inductive coupling and the second inner inductive coupling, and the second inner annular barrier being arranged below the second inner inductive coupling, so that the second inner inductive coupling is arranged in the first inner zone.

4. The downhole completion system according to claim 3, wherein the inner production casing comprises a completion component arranged between the first inner annular barrier and the second inner annular barrier.

5. The downhole completion system according to claim 4, wherein the second inner inductive coupling is connected with the completion component.

6. The downhole completion system according to claim 4, wherein the completion component is an actuator for moving a sleeve in order to cover or uncover at least one inner opening in the inner production casing.

7. The downhole completion system according to claim 3, wherein a third inner annular barrier is arranged below the second inner annular barrier to provide a second inner zone opposite the second outer zone.

8. The downhole completion system according to claim 7, wherein a third inner inductive coupling is arranged in the second inner zone, the third inner inductive coupling being wireless.

9. The downhole completion system according to claim 3, wherein the inner production casing has an upper part separated from a lower part, the first inner inductive coupling is arranged on the upper part, and the first inner annular barrier is arranged on the lower part.

10. The downhole completion system according to claim 9, wherein the lower part has a polished bore receptacle for receiving the upper part.

11. The downhole completion system according to claim 9, wherein the upper part has no annular barriers.

12. The downhole completion system according to claim 9, wherein the first inner annular barrier is the barrier closest to the top.

13. The downhole completion system according to claim 3, wherein the annular barrier comprises:

a tubular metal part for mounting as part of the production casing, the tubular metal part having a first expansion opening and an outer face, an expandable metal sleeve surrounding the tubular metal part and having an inner face facing the tubular metal part and an outer face facing a wall of the borehole or an inner face of another production casing, each end of the expandable metal sleeve being connected with the tubular metal part, and an annular space between the inner face of the expandable metal sleeve and the tubular metal part, the expandable metal sleeve being configured to expand by entering pressurised fluid into the annular space through the first expansion opening.

14. The downhole completion system according to claim 1, wherein the outer production casing comprises a first outer annular barrier and a second outer annular barrier to provide zonal isolation of a first outer zone in the primary annulus.

15. The downhole completion system according to claim 14, wherein the outer production casing has at least one outer opening between the first outer annular barrier and the second outer annular barrier.

16. The downhole completion system according to claim 14, wherein the second electrical conductor electrically connects the first outer inductive coupling and the second outer inductive coupling, the second electrical conductor extending through the first outer annular barrier.

17. The downhole completion system according to claim 14, wherein a third outer annular barrier is arranged below the second outer annular barrier to provide a second outer zone, and a third outer inductive coupling is arranged in the second outer zone and is connected with the second outer inductive coupling by a third electrical conductor.

18. The downhole completion system according to claim 1, wherein an intermediate outer inductive coupling is arranged on the outer face of the outer production casing above the main barrier and positioned substantially in the same horizontal level as the first inner inductive coupling for wireless transfer of communication signals and/or power therebetween, and the intermediate outer inductive coupling is connected with the first outer inductive coupling via the second electrical conductor.

19. A downhole communication or transferring method of using the downhole completion system according to claim 1, comprising:

sending a signal and/or power from the top to the first inner inductive completion through the first electrical conductor, wirelessly transferring the signal and/or power from the first inner inductive coupling to the first outer inductive coupling, sending the signal and/or power from the first outer inductive coupling to the second outer inductive coupling through a second electrical conductor, and wirelessly transferring the signal and/or power from the second outer inductive coupling to the second inner inductive coupling.

* * * * *